US011561072B1

(12) United States Patent
Larsen

(10) Patent No.: US 11,561,072 B1
(45) Date of Patent: Jan. 24, 2023

(54) PORTABLE WIND RESISTANT TARGET AND SIGN STAND

(71) Applicant: Greg Larsen, Novato, CA (US)

(72) Inventor: Greg Larsen, Novato, CA (US)

( * ) Notice: Subject to any disclaimer, the term of this patent is extended or adjusted under 35 U.S.C. 154(b) by 0 days.

(21) Appl. No.: 17/455,919

(22) Filed: Nov. 21, 2021

Related U.S. Application Data

(63) Continuation-in-part of application No. 17/211,804, filed on Mar. 24, 2021, now abandoned.

(51) Int. Cl.
*G09F 15/00* (2006.01)
*F41J 1/10* (2006.01)
*F41J 7/00* (2006.01)

(52) U.S. Cl.
CPC . *F41J 1/10* (2013.01); *F41J 7/00* (2013.01); *G09F 15/0068* (2013.01); *G09F 15/0087* (2013.01)

(58) Field of Classification Search
CPC ..... G09F 15/0068; G09F 15/0087; F41J 1/10; F16L 47/00
See application file for complete search history.

(56) References Cited

U.S. PATENT DOCUMENTS 3,080,166 A * 3/1963 Clark ..... F41J 1/10 248/201
3,583,703 A * 6/1971 Brown ..... A63B 63/00 473/456
4,295,648 A * 10/1981 Stromback ..... A63B 63/00 473/456
4,629,188 A * 12/1986 Mahieu ..... A63B 63/00 473/454
4,718,668 A * 1/1988 Schipske ..... A63B 63/00 473/462
5,029,853 A * 7/1991 Cunningham ..... A63B 61/003 473/459
5,067,683 A * 11/1991 Wager ..... F41J 1/10 248/156
5,209,492 A * 5/1993 Hamilton ..... F41J 1/10 248/463
5,573,240 A * 11/1996 Humboldt ..... A63B 63/00 473/454
5,678,824 A * 10/1997 Fortier ..... F41J 1/10 273/400
5,938,203 A * 8/1999 Beckwith, Sr. ..... F41J 1/10 273/407
6,209,876 B1 * 4/2001 Franklin ..... A63F 7/305 273/317.5

(Continued)

*Primary Examiner* — Gary C Hoge
(74) *Attorney, Agent, or Firm* — Ivan E. Rozek; Savantek Patent Services

(57) ABSTRACT

A portable wind resistant target and sign stand, that is lightweight, wind resistant and can be stored in a relatively small container approximately two feet tall and five inches in diameter. The stand is made of rigid pipes that can be rapidly and easily assembled and disassembled without tools, The stand can accommodate target or sign panels of varying height or width, as the backdrops can be secured at any position along the vertically adjustable, horizontally disposed, rigid crossbars by a plurality of spring clips or, alternatively, a plurality of magnets if said crossbar is made of ferrous metal. Wind resistance is enhanced by a novel three-way-tee fitting assembly developed for this application.

3 Claims, 11 Drawing Sheets

(56) References Cited

U.S. PATENT DOCUMENTS

| | | | | |
|---|---|---|---|---|
| 6,435,512 | B1 * | 8/2002 | Beckwith, Sr. | F41J 1/10 273/403 |
| 6,497,268 | B1 * | 12/2002 | Peppett | E04B 2/7427 160/374.1 |
| D478,938 | S * | 8/2003 | Vande Hey | D21/699 |
| 8,162,320 | B2 * | 4/2012 | Medina | F41J 1/10 273/410 |
| 9,255,773 | B1 * | 2/2016 | Hall | F41J 7/00 |
| 2010/0057017 | A1 * | 3/2010 | Pappas | A61M 5/1417 604/257 |
| 2010/0194048 | A1 * | 8/2010 | Medina | F41J 1/10 273/407 |
| 2012/0068412 | A1 * | 3/2012 | Diercks | G09F 15/0018 40/606.01 |
| 2015/0362296 | A1 * | 12/2015 | Medendorp | F41J 1/10 273/385 |
| 2016/0298942 | A1 * | 10/2016 | Skinner | F41J 1/10 |
| 2018/0045495 | A1 * | 2/2018 | Harris | F41J 1/10 |
| 2021/0102785 | A1 * | 4/2021 | Fountain | F41J 1/10 |

* cited by examiner

PORTABLE WIND RESISTANT TARGET AND SIGN STAND

CROSS REFERENCE TO RELATED APPLICATIONS

This application is a continuation-in-part of U.S. patent application Ser. No. 17/211,804 filed Mar. 3, 2021, the entire contents of which is incorporated herein by reference for continuity of disclose.

STATEMENT REGARDING FEDERALLY SPONSORED RESEARCH OR DEVELOPMENT

Not Applicable.

DESCRIPTION OF ATTACHED APPENDIX

Not Applicable.

BACKGROUND OF THE INVENTION

This invention relates generally to the field of target support stands and specifically to a portable target and sign stand that can accommodate target and sign backdrops of varying heights and widths.

BRIEF SUMMARY OF THE INSTANT INVENTION

The primary object of the invention is to provide a portable target stand and sign stand that is lightweight, wherein the support members of the stand can be easily set up and taken down to fit in a compact enclosure for easy transport.

Another object of the invention is to provide a portable target stand and sign stand which can accommodate, and be adjusted without tools to rapidly support, target or sign panels of varying heights and widths due to the presence of vertically adjustable, horizontally disposed, rigid crossbars.

Yet another object of the invention is to provide a portable target stand and sign stand which can stay stable when exposed to wind.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a portable target and sign stand that is constructed of rigid pipes and connectors that form a horizontally disposed H-shaped base portion and a vertically disposed left and right post removably attached to the H-shaped base portion as well as a plurality of horizontally disposed, rigid crossbars removably attached to the right and left vertical posts via U shaped fasteners. A plurality of spring biased clips or bolts fastened by wingnuts is used to attach a target or sign panel to said crossbars. Alternatively, a plurality of magnets can be used to attach a target or sign panel to said crossbar if crossbar is made of ferrous metal.

BRIEF DESCRIPTION OF THE DRAWINGS

The drawings constitute a part of this specification and include exemplary embodiments to the instant invention, which may be embodied in various forms. It is to be understood that in some instances various aspects of the instant embodiments may be shown exaggerated or enlarged to facilitate an understanding of the instant embodiment.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure, or manner.

Figure 1:
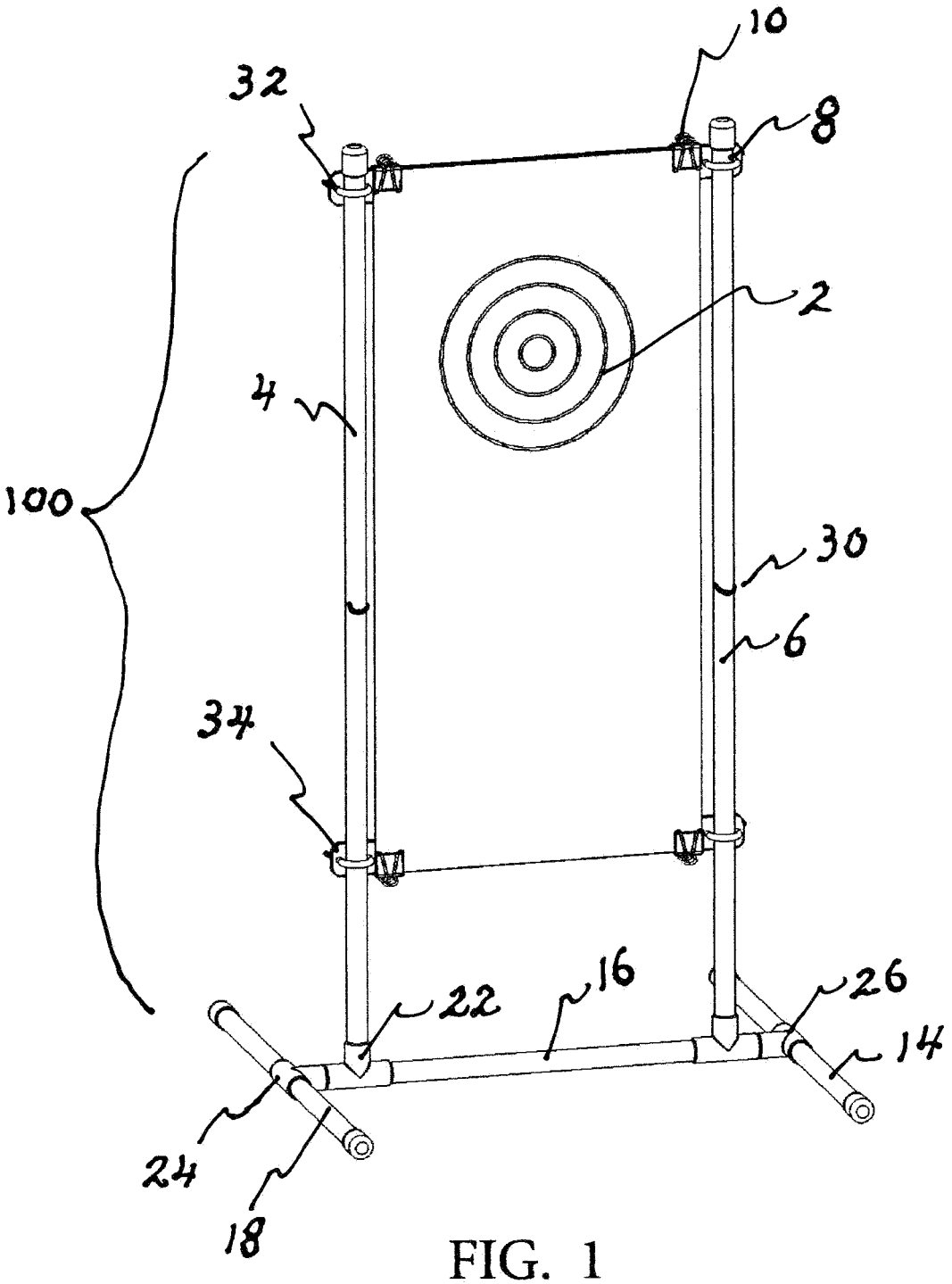
FIG. 1 is a perspective view of the embodiment with a target panel attached to a backdrop.
Figure 2:
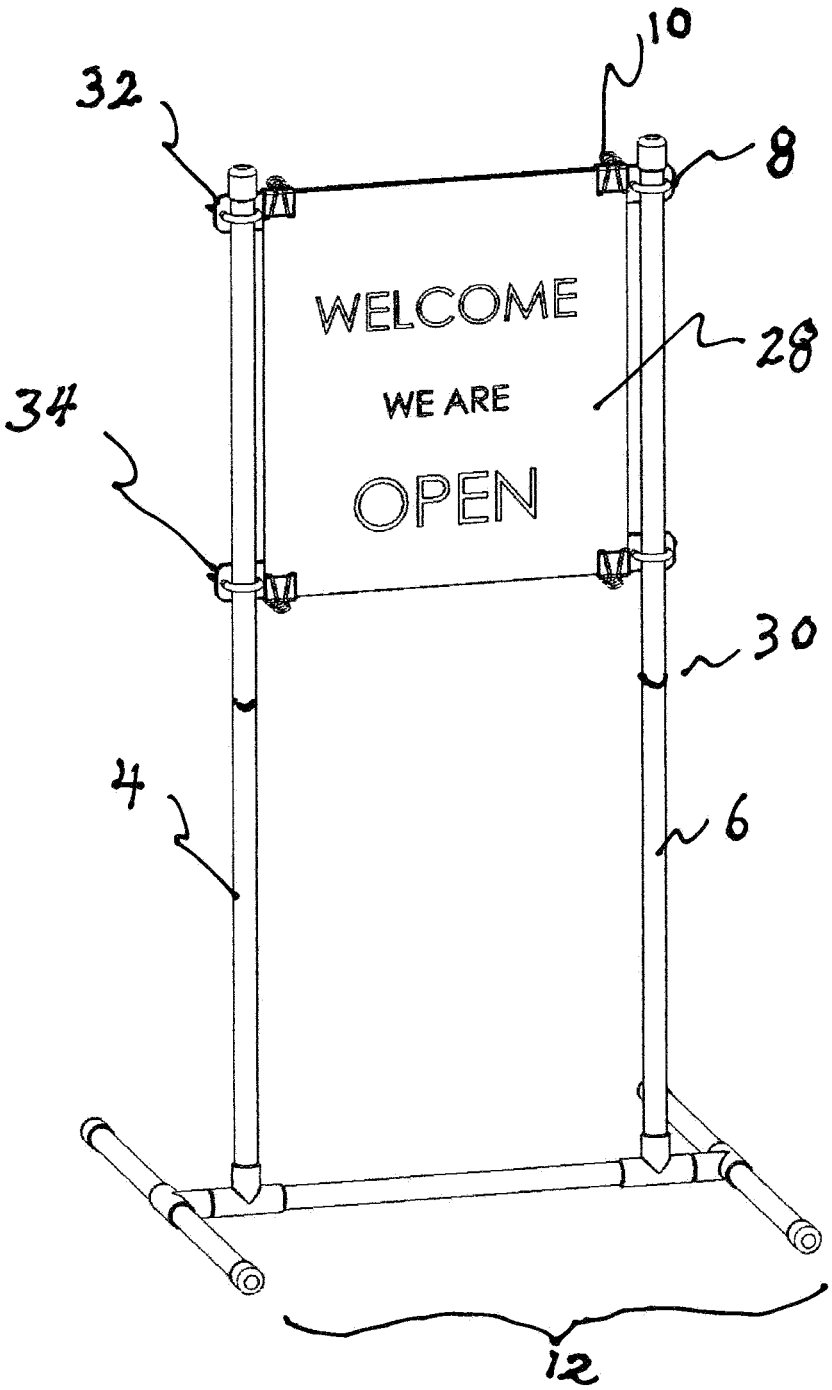
FIG. 2 is a perspective view of the embodiment with a sign panel attached to a backdrop.
Figure 4:
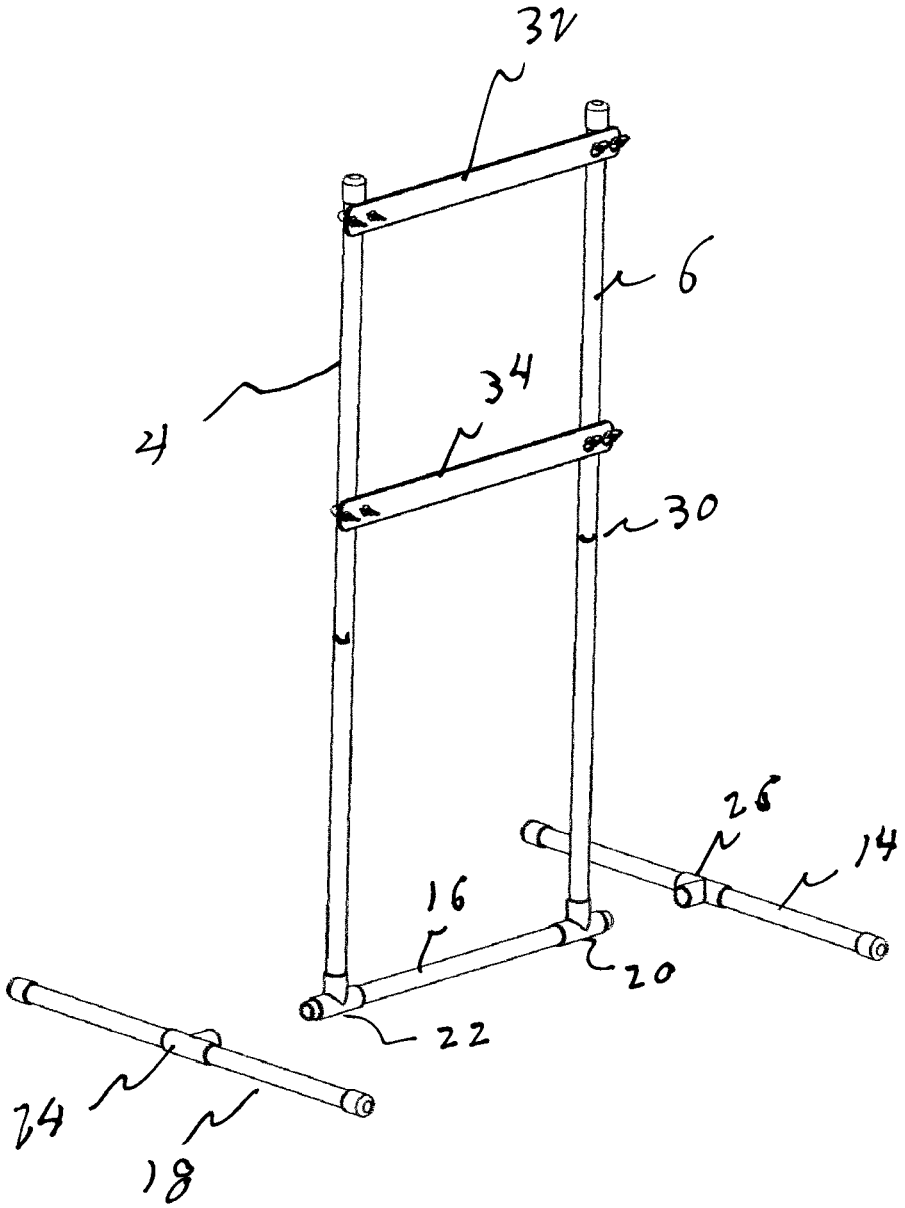
FIG. 4 is an exploded view of the portable target and sign stand.

Referring now to FIG. 1 we see a perspective view of the embodiment 100. An H-shaped base 12, as shown in FIG. 2, is made of two or more left 4 and two or more right 6 pipe members attached via three-way-tee fitting assembly 22, 24, to the central pipe member 16. Second three-way-tee connector assembly 20, 26, as seen in FIG. 4, engage the central tubular member 16 so that the left 4 and right 6 vertical tubular supports are positioned ninety degrees from the base. Alternately, the three-way-tee connector assembly can be replaced by standard individual three-way-tee fittings that the user can elect to rotate to an alternate angle if so desired. Vertical support tubes 4, 6 each are formed by at least two equal lengths of tube that are connected at location 30 by standard connector members not shown. The support frame 100 is typically approximately two feet wide and four feet tall. Since the vertical tubes 4, 6 can be detached at location 30, and the base cross base support pipes 14, 18 can be detached from central pipe 16, the entire support assembly 100 can be taken apart and stored in a pouch that is approximately two feet tall and five inches in diameter. The target 2 shown in FIG. 1 is held to horizontally disposed, rigid crossbars 32, 34 via spring biased clips 10. The horizontally disposed, rigid crossbars 32, 34 are fastened to the vertical support tubes 4, 6 via U shaped retaining members 8. The U shaped retaining members are attached through apertures in the horizontally disposed, rigid crossbars 32, 34 and slidably held in place by wing nuts 38 shown in FIG. 5.

FIG. 2 is a perspective view of a sign panel 28 being held to the horizontally disposed, rigid crossbars 32, 34 via spring biased clips 10.

Figure 3:
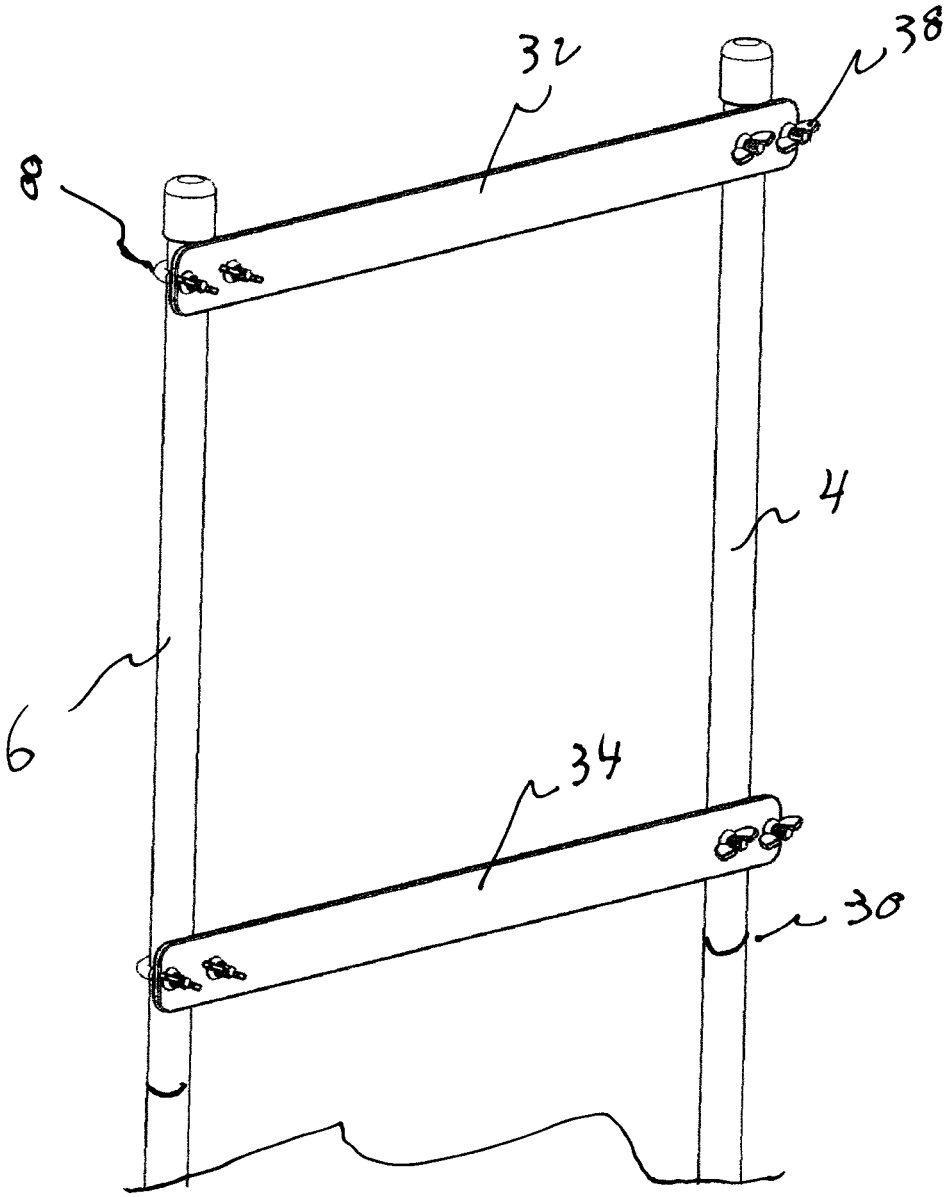
FIG. 3 is a partial perspective rear view of the embodiment showing the attachment of the horizontally disposed, rigid crossbars.

FIG. 3 is a partial perspective rear view of the upper portion of the stand 100 clearly showing horizontally disposed, rigid crossbars 32, 34 attached by U shaped retaining members 8 via wing nuts 38. The user can without tools rapidly adjust the height of the horizontally disposed, rigid crossbars 32, 34 by loosening the wing nuts 38 and sliding the U shaped members 8 up or down, uniquely allowing for target or sign panels of different heights. Additionally, the user can slide spring biased clips 10 inward or outward, along the horizontally disposed, rigid crossbars 32, 34, uniquely allowing for target or sign panels of different widths.

FIG. 4 is an exploded view of the portable target and sign stand showing base support members 14, 18 removed from central pipe 16. Second tee connectors 20, 22 can be slid off of central pipe 16 for compact storage of the embodiment 100.

Figure 5:
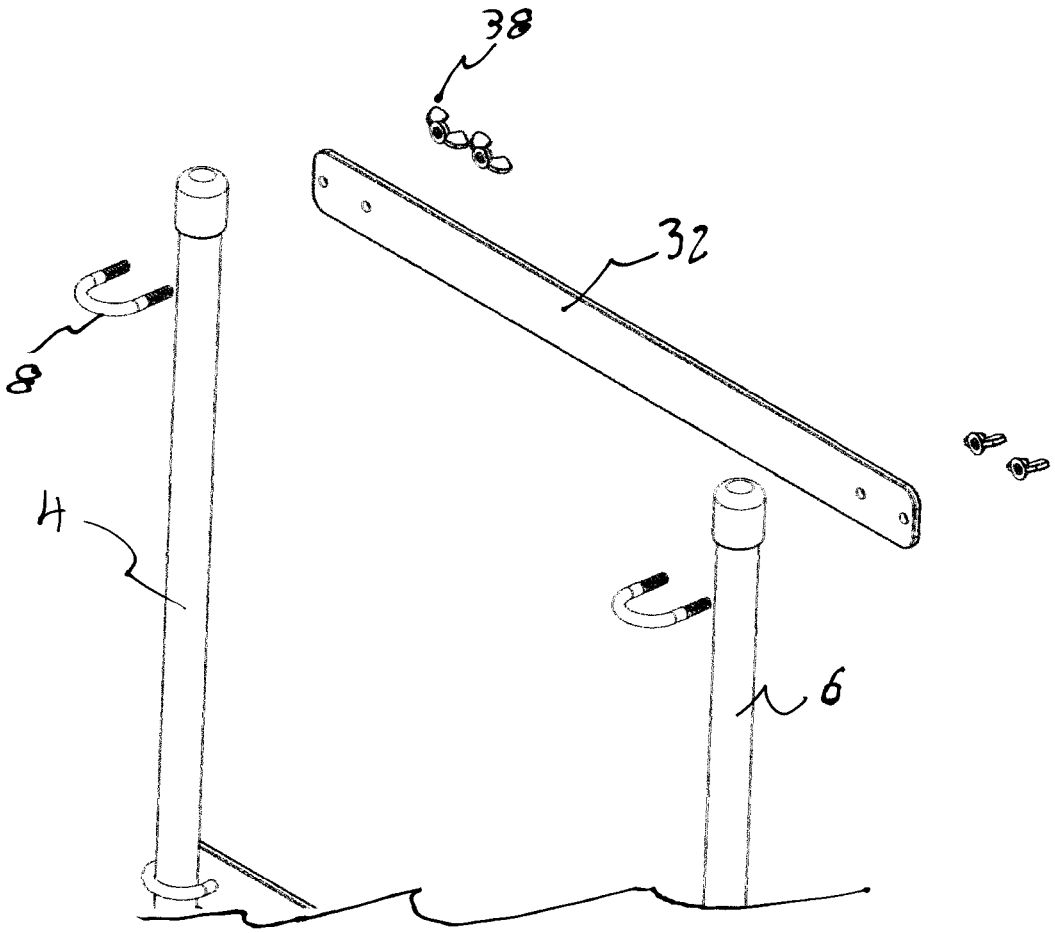
FIG. 5 is a partial exploded view of a horizontally disposed, rigid crossbar attaching to the vertical support posts.

FIG. 5 is a partial exploded view showing horizontally disposed, rigid crossbar 32 about to be attached to left 4 and right 6 vertical tubes via U shaped retaining members 8 and wing nuts 38.

Figure 6:
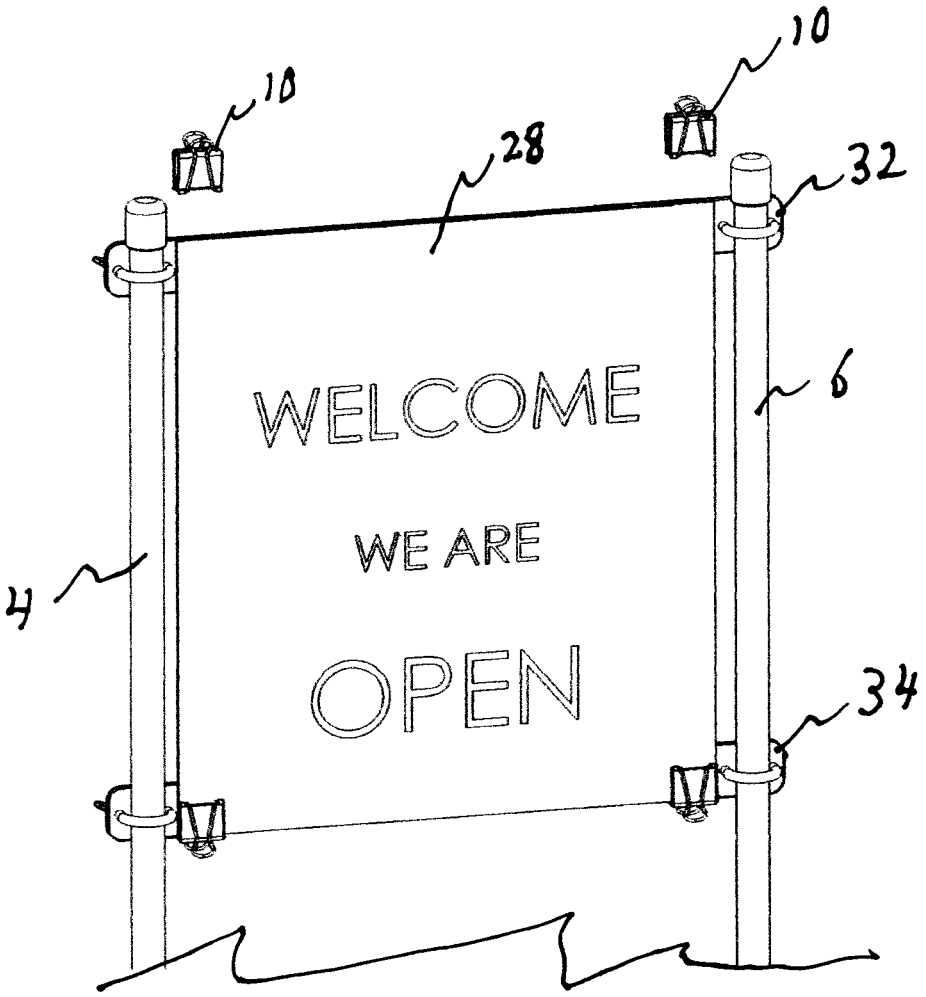
FIG. 6 is a partial perspective view of a sign panel being held by spring biased clips.

FIG. 6 is a partial perspective view showing spring biased clip 10 about to be attached to sign panel 28 and horizontally disposed, rigid crossbar 32.

Figure 7:
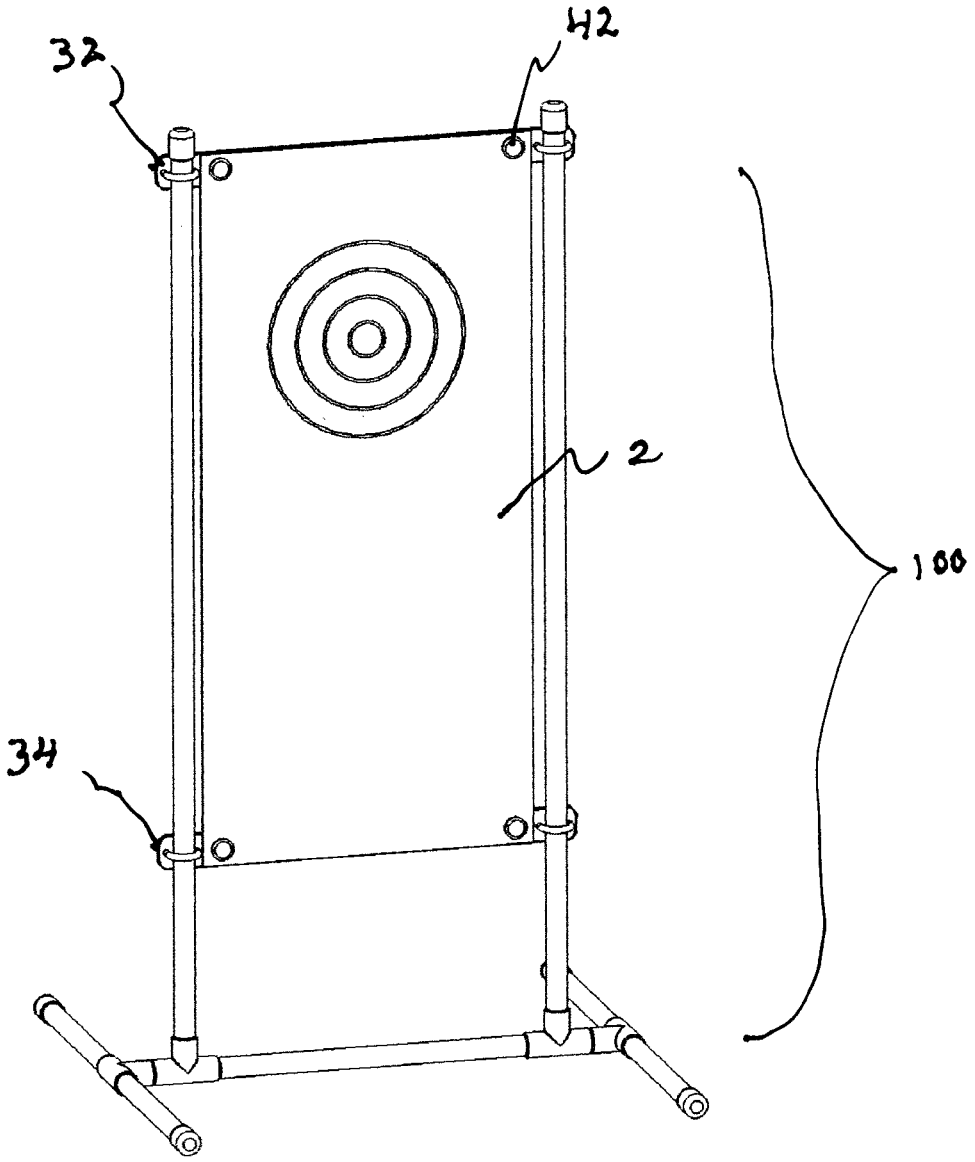
FIG. 7 is a perspective view of a target panel attached by magnets to ferrous metal crossbars.

FIG. 7 is a perspective view of the embodiment 100 with the target panel 2 being held to ferrous metal crossbars 32, 34 by magnets 42.

Figure 8:
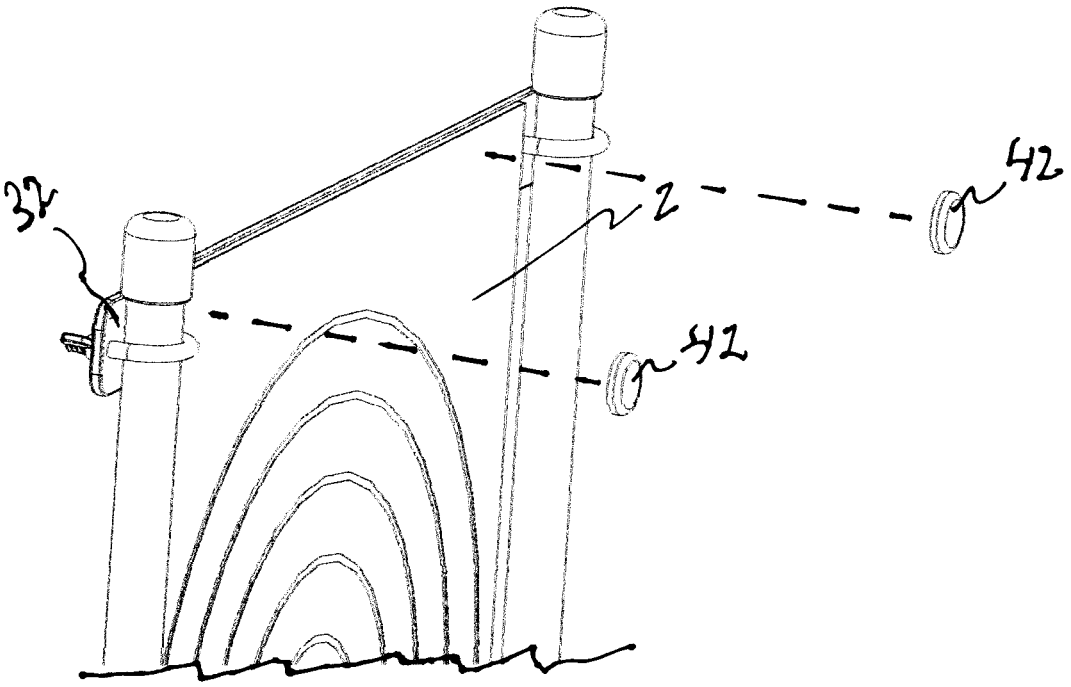
FIG. 8 is a partial exploded perspective view of a target panel about to be attached to a ferrous metal crossbar made using magnets.

FIG. 8 is a partial exploded perspective view of the embodiment with magnets 42 about to be installed on target panel 2 where their magnetic force penetrates target panel 2 and attaches magnetically to ferrous metal crossbar 32.

The entire assembly 100 can be assembled and disassembled by a person without the need of standard tools. The entire assembly, excluding the horizontally disposed, rigid crossbars, is preferably made of light weight PVC or other plastic material making it easy to transport.

Figure 9:
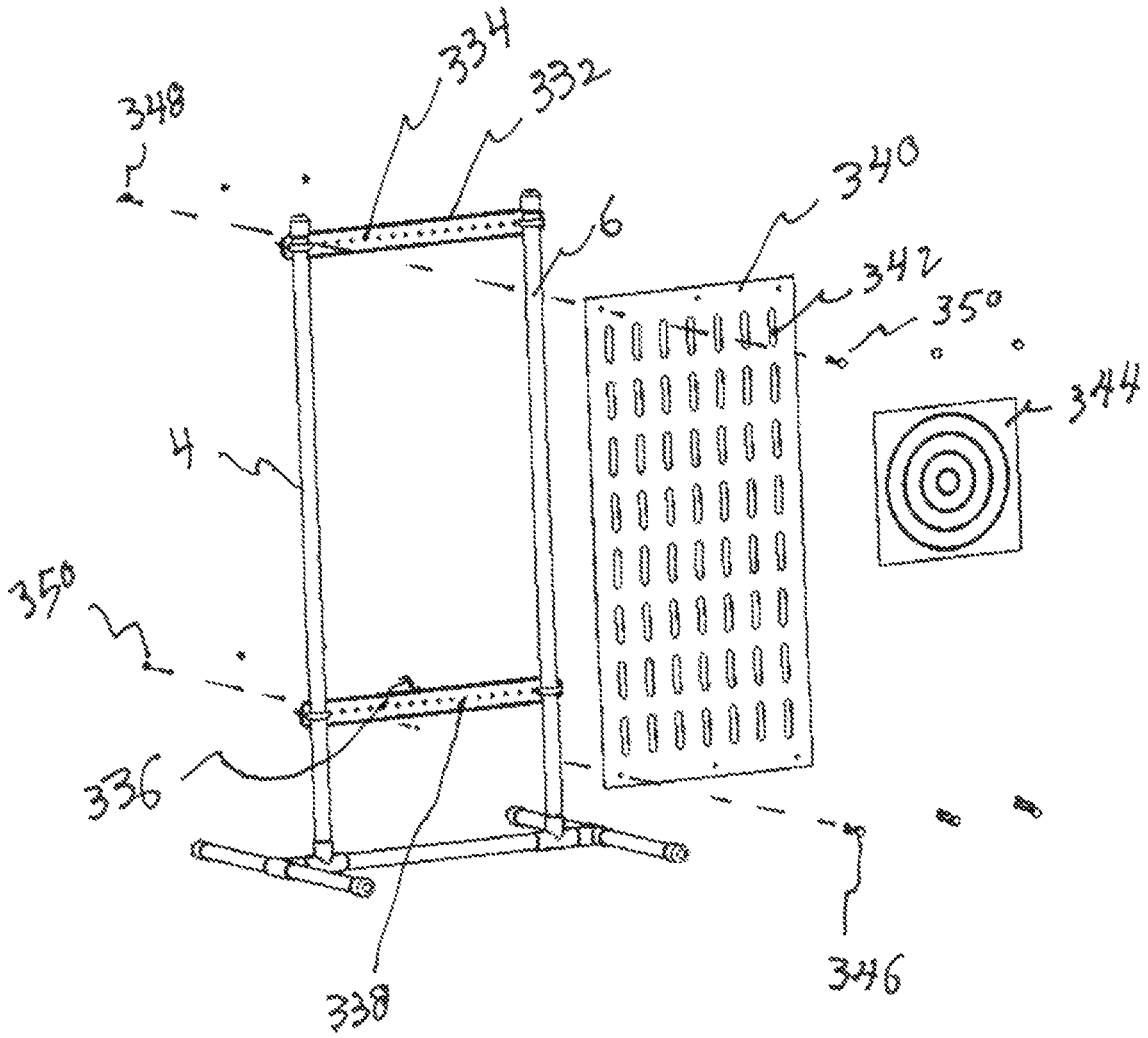
FIG. 9 is an exploded view of the stand where the cross bars are perforated wherein a backdrop can be attached as a support for a replaceable sign or target sheet.

FIG. 9 is an exploded view of the embodiment 100 with the metal cross bars 332, 336 having equally spaced holes 334, 338 which allow the attachment of a backdrop of thin plastic material 340 such as the Dupont sheet Tyvek or of a ferromagnetic sheet, the thickness of which is selected to be penetrable by a projectile discharged at the target from a weapon. The backdrop 340 is perforated with a plurality of slots 342 allow air to pass through the backdrop 340 on windy days thereby reducing the change of having the stand 100 blow over in the wind. Two sets of three screws 346, 350 and wing nuts 350, 348 attach the backdrop to the cross bars 332, 336. A standard paper target 344 has adhesive backing to attach the target 344 to plastic backdrop 340.

Figure 10:
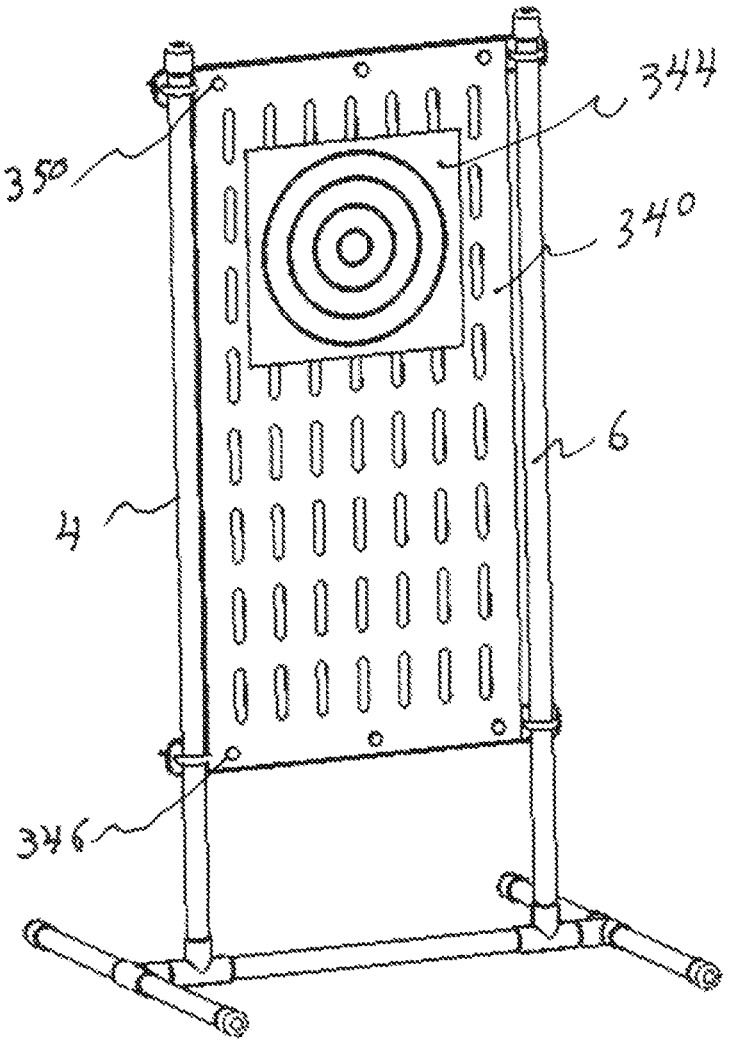
FIG. 10 is a perspective view of the stand with the backdrop and a target sheet in place.

FIG. 10 is a perspective view of the embodiment 100 showing the plastic backdrop 340 attached to the cross bars 332, 336 and the target 344 adhered in place on the backdrop 340.

Figure 11:
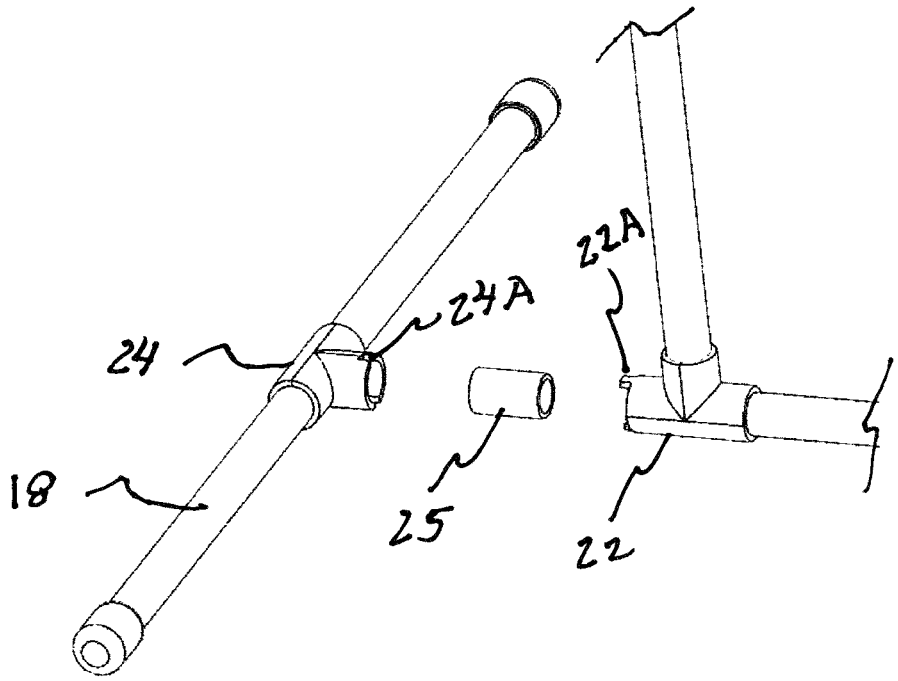
FIG. 11 is a perspective view of the novel three-way-tee fitting assembly.

FIG. 11 shows a perspective view of the novel three-way-tee fitting assembly comprised of two modified three-way-tee fittings and a short tube frictionally inserted into the short arms of both three-way-tee fittings.

One of the modified three-way-tee fitting's short arm includes two slots, disposed opposite of each other, while the other three-way-tee fitting's short arm includes two notches also disposed opposite of each other. The slots and notches are sized to mate frictionally.

The short tube, frictionally inserted into the two modified three-way-tee fittings is not visible when the fittings are joined. Additionally, the short tube is electro welded to the fittings.

The herein described novel three-way-tee fitting assembly was developed to make the stand wind resistant, that is, resistant to being tipped over in light to moderate winds.

It is to be understood that the described embodiments of the invention are illustrative only and that modifications thereof may occur to those skilled in the art. Accordingly, this invention is not to be regarded as limited to the embodiments disclosed but is to be limited only as defined by the appended claims herein. It will further be understood that any features described in relation to any particular embodiment may be featured in combinations with other embodiments, for avoidance of doubt. While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

Definitions

The terms "backdrop" and "attachment board" may be used interchangeably.

What is claimed is:

1. A portable lightweight wind resistant target and sign display stand comprising an essentially vertical reconfiqurable target and sign display portion, vertical uprights comprised of a plurality of stackable pipes, an essentially horizontal H-shaped base comprised of a plurality of rigid pipes, wherein:

a left leg of the H-shape comprised of a plurality of rigid pipes and of a non-slip three-way-tee fitting assembly;

a right leg of the H-shape comprised of a plurality of rigid pipes and of a non-slip three-way-tee fitting assembly, wherein the right leg and the left leg of the H-shape are mirror images of each other;

wherein the non-slip three-way-tee fitting assembly comprises:

a first three-way-tee fitting, comprised of a straight through pipe section and a short pipe section perpendicular to the straight through section, wherein the short pipe section includes two slots, the two slots being disposed diagonally opposite of each other;

a second three-way-tee fitting, comprising a straight through pipe section and a short pipe section perpendicular to the straight through section, wherein one end of the straight through pipe section includes two notches, the two notches being disposed diagonally opposite of each other;

a short pipe frictionally inserted and connecting the first three-way-tee fittings and into the second three-way-tee fittings, wherein the two notches of the second three-way-fitting frictionally mate into the two slots of the first three-way-tee fitting; and the short pipe being electro welded within the short pipe section of the first three-way-tee fitting and to the straight through section of the second three-way-tee fitting creating a solid subassembly.

2. The portable lightweight wind resistant target and sign display system of claim 1, wherein a rigid upper and a rigid lower horizontal display mount bars are adjustably attached to the left and the right vertical uprights:

the lower and the upper horizontal mount display bars attached to the vertical left and right uprights with U-bolts, wherein a vertical attachment location is selected to match a target or a sign backdrop to which a sign or a target to be displayed may be attached; and a target or a display being attached to the display backdrop by any temporary means selected from clips, screws, or magnets.

3. The portable lightweight wind resistant target and sign display system of claim 2, wherein the sign or target backdrop is a ferromagnetic backdrop penetrable by a projectile discharged from a weapon.

* * * * *